United States Patent [19]

Ohlson

[11] Patent Number: 5,054,471

[45] Date of Patent: Oct. 8, 1991

[54] FEMALE BREAST TREATMENT ARRANGEMENT

[76] Inventor: Sven-Åke Ohlson, Lindgatan 1 B, S-653 42 Karlstad, Sweden

[21] Appl. No.: 497,516

[22] Filed: Mar. 22, 1990

[51] Int. Cl.[5] ..... A61H 9/00

[52] U.S. Cl. ..... 128/24 R; 128/24.1; 128/33; 128/65; 128/66

[58] Field of Search ..... 128/33, 38, 39, 66, 128/70, 72, 74, 853

[56] References Cited

U.S. PATENT DOCUMENTS

| | | | |
|---|---|---|---|
| 1,938,006 | 12/1933 | Blanchard | 128/74 |
| 2,911,969 | 12/1957 | Woodward et al. | 128/66 |
| 3,667,455 | 6/1972 | Courtin | 128/66 |
| 4,479,492 | 10/1984 | Singer | 128/853 |
| 4,903,689 | 2/1990 | Lannertone | 128/72 |

*Primary Examiner*—Robert A. Hafer
*Assistant Examiner*—Brian E. Hanlon
*Attorney, Agent, or Firm*—Young & Thompson

[57] ABSTRACT

A female breast treatment arrangement comprises a bench supporting an elastically compressible mattress having a chest supporting portion in combination with a forward head, arm and shoulder supporting portion sloping downwards from the chest portion to obtain a bow of the chest and relaxed breasts of the woman being treated. The breasts depend through an opening in the chest portion of the mattress and are positioned above a shower tray, at the bottom of which is an outlet and two spray nozzles to provide showers of alternating cold and warm water against the breasts.

7 Claims, 2 Drawing Sheets

FEMALE BREAST TREATMENT ARRANGEMENT

The invention relates to a female breast treatment arrangement using hydro-therapy.

In U.S. Pat. No. 2,911,969 a breast developer is disclosed in which the female breasts depend into a basin which is alternately filled with cold and warm water respectively to treat the female breasts during predetermined intervals. Water is discharged from the basin through an outlet disposed at the upper end of the basin, so that the main portions of the breasts will be submerged in a water bath of varying temperature.

Since the water is supplied to the basin through nozzles at the bottom of the basin, and the outlet is at the upper end of the basin, the nozzles will not be able to deliver showers against the breasts. Further, the shifting between cold and warm water in the basin will proceed gradually during a relatively long period of time necessary for supplying cold water to the warm water in the basin until the temperature has decreased to the desired cold water temperature, and vice versa.

Moreover, the known breast treatment bench has a flat table surface so that the shoulders of the woman will be held in a position somewhat retracted from normal position resulting in stretching of the skin and muscles of the breasts. This in turn results in a reduced blood circulation compared with a position where the woman is bowing downwardly and has moved the shoulders forwardly so that the chest is bowed and the breasts are depending as free and relaxed as possible.

It is therefore a general object of the invention to provide a female breast treatment arrangement in which the breasts depend in a relaxed condition into a tray in which cold and warm water respectively may momentarily be shifted and directed unobstructed upwardly against the relaxed breasts of the woman.

These and other objects and details will be disclosed more in detail with reference to the accompanying drawings showing a preferred embodiment of the invention.

Figure 1:
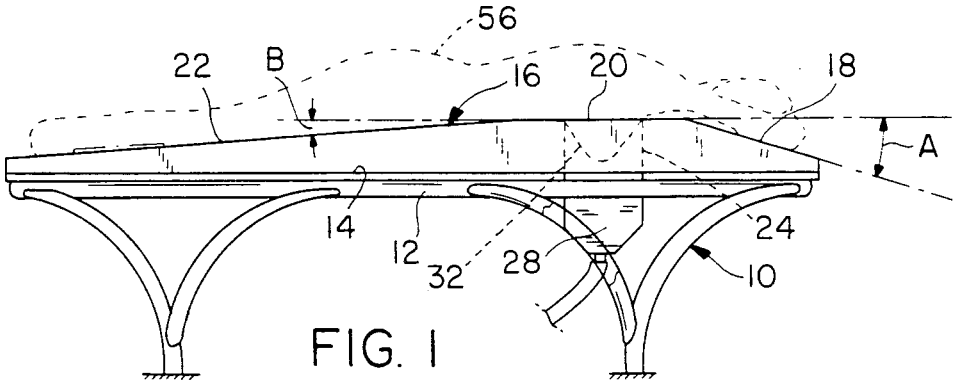
FIG. 1 is an elevational view of a breast treatment arangement according to the invention.
Figure 2:
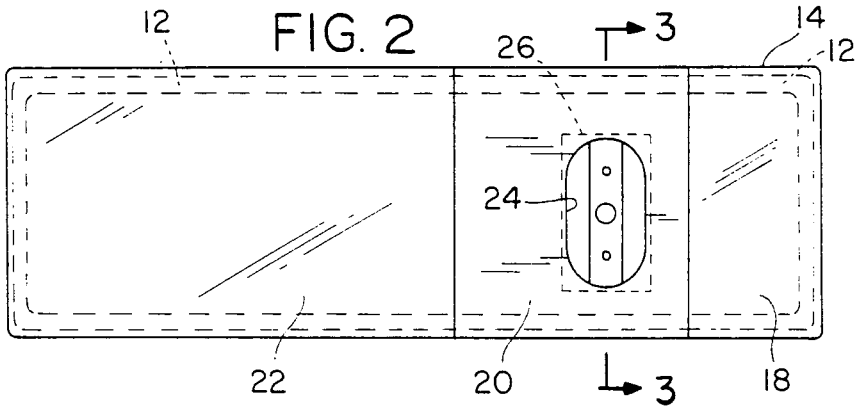
FIG. 2 is a plan view of the device in FIG. 1.

As shown in FIGS. 1 and 2, the female breast treatment arrangement comprises a supporting structure or bench 10 of steel tubes having an upper horizontal frame 12 supporting a table 14 of reinforced plastics material. An elestically compressible mattress 16 of foam plastics material is placed on the table.

The mattress has a forward sloping front or head and arm portion 18, a substantially horizontal chest supporting portion 20 and a rearward sloping rear or leg supporting portion 22.

Figure 3:
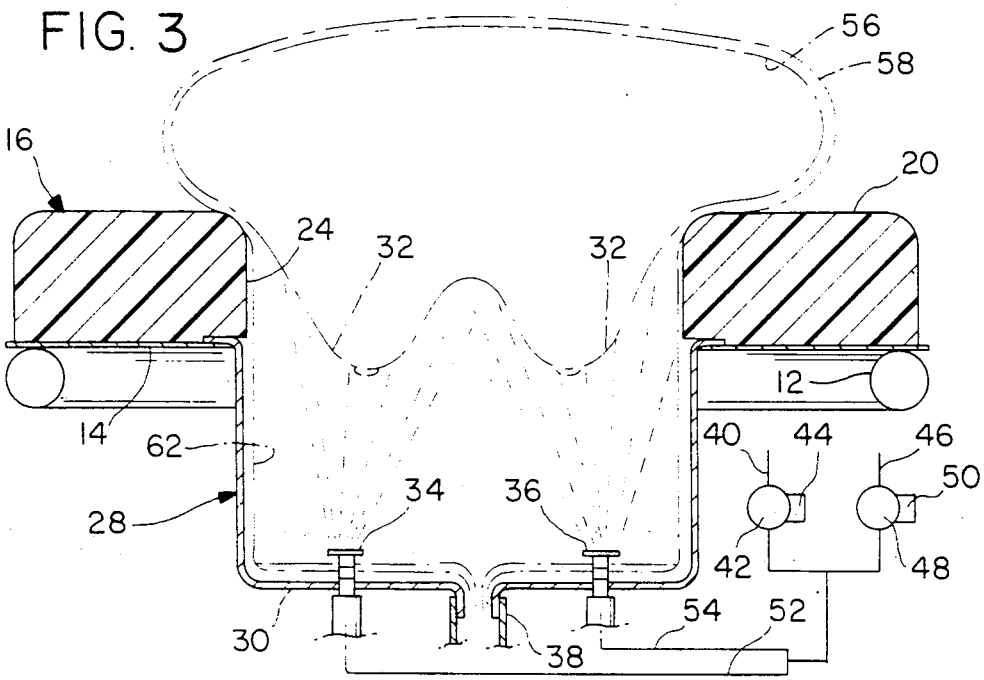
FIG. 3 is an enlarged sectional view along line 3-3 in FIG. 2.

In the chest portion is a through-going opening 24 aligned with an opening 26 in the table 14. The openings are substantially equal in size and are oblong as shown to receive two breasts. A shower tray 28 has its upper edges supported by the edges of the opening 26 as shown in FIG. 3.

The bottom 30 of the tray is located at a depth below the disc 14 which is sufficient to allow various sizes of women breasts 32 to depend freely down in the tray at suitably free height above two water spray nozzles 34, 36 mounted at the bottom 30 and being located at free-height thereabove to be unobstructed by waterflow on the bottom. The height of the nozzles may be adjustable.

Between the nozzles is an outlet 38, dimensioned to prevent the water level from raising above the nozzles when the nozzles are spraying water.

Cold water is supplied from a conduit 40, through a dispensing valve 42 operated by an electrical regulated control device 44 to deliver the desired amount cold water during a predetermined interval to be mixed with warm water delivered from a conduit 46, through a dispensing valve 48 operated by an electrically regulated control device 50.

Water mixed to the desired temperature is then led through conduits 52, 54 to the spray nozzles 34 and 36 respectively.

Cold water at a temperature of 12° to 20° C., preferably about 15° C., is delievered during a period of time between 2 to 5 seconds, preferably about 3 seconds, and thereafter warm water at a temperature between 35° and 45° C., preferably about 40° C., is delivered during a peroid of time between 3 to 7 seconds, preferably about 4 seconds. The cold and warm water intervals are shifted substantially momentarily my means of a timer controlling the control devices 44 and 50.

A hydro-theraphy treatment may last about 15 minutes and could for example be given twice a week during a three week period as has been tested with good results.

The angle A between the plane of the chest portion 20 of the mattress and the plane of the forward portion 18 is in the range of about 10° to about 20°, whereas the angle B between the portions 20 and 22 is between about 5° and about 10°.

Figure 5:
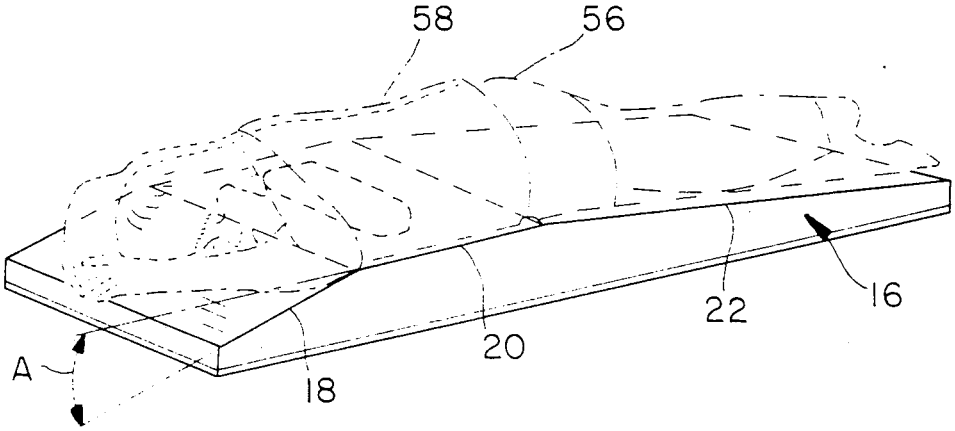
FIG. 5 is a diagrammatic perspective view of a woman lying on the mattress and surrounded by the towel in FIG. 4.

As illustrated in FIGS. 1 and 5, the woman 56 lying on the mattress will bow over the chest portion 20 with her shoulders, arms and head resting on the sloping front portion 18. In this position, the skin and muscle areas of the breasts 32 will be slackened so that the breasts will depend in the opening 24 in a relaxed condition which will provide less resistance to flow of blood in the vein system in the breasts.

Figure 4:
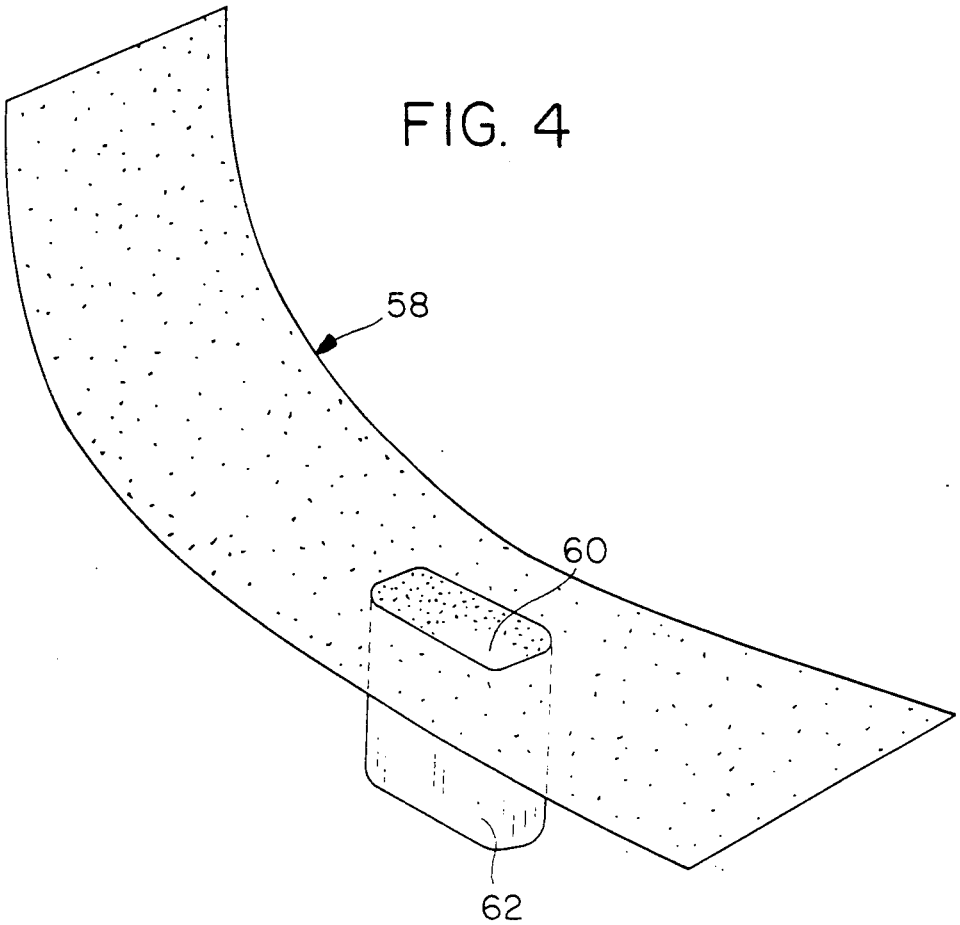
FIG. 4 is a diagrammatic perspective view of a specific towel to be used in combination with the device according to the invention.

The towel 58 shown in FIG. 4 has a width and length to be wound around the chest of the woman to be treated. The towel has an opening 60 and a tubular extension 62 connected to the towel around the opening 60. The tubular extension is placed to hang down through the openings 24, 26 in the mattress and the table respectively and into the tray 28 to be positioned along its side walls. Thereafter the woman is placed on the towel and the towel is swept around the woman.

Primarily, the towel 58 is used for sanitary reasons but it will also provide a soft and comfortable surface met by the depending breasts which are thus prevented from coming into contact with surfaces contacted by another woman having used the treatment bench.

An important part of the blood circulation obtained with the device described and shown consists in the Anteriole is affected by warm and cold temperatures. It is contracted by cold temperatures which cause a reduction in the blood flow and is conversely expanded by heat, causing a corresponding increase in the blood flow. The warm and cold water treatment strengthens the cell tissue as this is renewed due to the increased oxygen supply during the expansion period and the removal of waste products by means of the blood flow.

Upon testing as described above, that is after a three weeks of treatment, the distance from the hollows between the cellar bones (incisuna jungularis) to each nipple (papilla mammae) was again measured. It was concluded that this distance has decreased considerably as a result of the treatment, i.e. that the breasts had contracted with a lasting improvement in firmness.

The arrangement according to the invention can utilize already existing equipment for control of cold water and warm water supply respectively to the nozzles which means cost savings in production. It is only necessary to shape the mattress with the sloping front portion and provide the necessary breast receiving opening in the mattress and the table and to mount the relatively cheap tray with its nozzles and outlet at its bottom.

I claim:

1. A female breast treatment arrangement comprising a table, an elastically compressible mattress on the table a through-going breast receiving opening in a chest supporting portion of the mattress, a mounting opening in the table aligned with the breast receiving opening, a shower tray mounted below the mounting opening, said openings having a greater extension transversely of the mattress than in its longitudinal direction, a water outlet in the bottom of the tray, two upwardly directed water spray nozzles mounted at a predetermined height above the bottom of the tray and connected to an arrangement supplying cold water at a lower temperature during a first predetermined interval and warm water at a higher temperature during a second predetermined interval, the dimension of said outlet and said supply of water to the nozzles being such that the water level at the bottom of the tray will always be lower than the level at which the spray nozzles are located.

2. A female breast treatment arrangement as defined in claim 1, including a towel to be wound around the chest of the woman to be treated, said towel having a breast receiving opening and connected thereto a tubular extension of the towel material to depend along the sides of the tray through the openings and along the side walls of the tray.

3. A female breast treatment arrangement as defined in claim 1, the elastically compressible mattress being at the ends of the chest supporting portion extended with a leg supporting portion and a forward portion for supporting the shoulders, arms and head of the woman, the front portion sloping downwardly from the end of the chest portion so as to obtain a bow of the chest when resting on the chest portion and on the forward portion to attain relaxed breasts depending down into the breast receiving opening of the mattress.

4. A female breast treatment arrangement as defined in claim 3, in which the angle between the plane of the chest supporting portion and the plane of the front portion of the mattress is in the range of about 10° to about 20°.

5. A female breast treatment arrangement as defined in claim 3, said leg-supporting portion being inclined downwardly relative to said chest supporting portion at an angle between about 5° and about 10°.

6. A female breast treatment arrangement comprising a table, an elastically compressible mattress on the table, a through-going breast receiving opening in a chest-supporting portion of the mattress, a mounting opening in the table aligned with the breast-receiving opening, a shower tray mounted below the mounting opening, said openings having a greater extension transversely of the mattress than in its longitudinal direction, a water outlet in the tray, upwardly directed spray means mounted in the tray and connected to means for supplying cold water at a lower temperature during a first interval and warm water at a higher temperature during a second interval, the elastically compressible mattress being at the ends of the chest-supporting portion extended with a leg-supporting portion and a forward portion for supporting the shoulders, arms and head of the women, the forward portion sloping downwardly from the end of the chest-supporting portion so as to obtain a bow of the chest when resting on the chest-supporting portion and on the forward portion to attain relaxed breasts depending down into the breast-receiving opening of the mattress.

7. A female breast treatment arrangment as defined in claim 6, said leg-supporting portion being inclined downwardly relative to said chest supporting portion at an angle between about 5° and about 10°.

* * * * *